US005667131A

United States Patent [19]

Sugiyama

[11] Patent Number: 5,667,131

[45] Date of Patent: Sep. 16, 1997

[54] METHOD AND APPARATUS FOR PRESSURE-WELDING AN ELECTRIC WIRE TO A PRESSURE TERMINAL

[75] Inventor: Osamu Sugiyama, Shizuoka, Japan

[73] Assignee: Yazaki Corporation, Tokyo, Japan

[21] Appl. No.: 669,822

[22] Filed: Jun. 26, 1996

Related U.S. Application Data

[63] Continuation of Ser. No. 421,903, Apr. 14, 1995, abandoned.

[30] Foreign Application Priority Data

Apr. 14, 1994 [JP] Japan ..... 6-076054

[51] Int. Cl.[6] ..... H01R 43/00; H01R 43/02

[52] U.S. Cl. ..... 228/173.5; 228/5.1; 81/9.41; 30/90.1

[58] Field of Search ..... 228/173.5, 205, 228/212, 5.1, 44.7; 30/90.1; 219/56.1; 29/564.4, 860; 81/9.41

[56] References Cited

U.S. PATENT DOCUMENTS 3,707,099 12/1972 Pete ..... 81/9.51

3,819,104 6/1974 Lang ..... 228/173.5

4,922,072 5/1990 Topel et al. ..... 228/173.5

FOREIGN PATENT DOCUMENTS 63-35266 3/1988 Japan ..... H01R 4/24

*Primary Examiner*—Samuel M. Heinrich

*Attorney, Agent, or Firm*—Sughrue, Mion, Zinn, Macpeak & Seas

[57] ABSTRACT

A method and apparatus for pressure-welding an electric wire to a pressure terminal in a manner that minimizes the deformation of pressure-welding cutters when the connection wire is pressed fit into the pressure terminal and provides electrical connections. An electric wire pressure-welding apparatus (1) is provided with a guide (9) constituting a vertically-extended fixed member, side pressing plates (6) constituting moving members each capable of pivoting about shafts (8) arranged in the upper portions of grooves (9a) longitudinally cut in the respective sides of the guide (9), and a sleeve (5) vertically slidable along the outer surfaces of the guide (9), and pressure-welding dies (2) each secured to the lower portion of the sleeve. An insulated wire (20) is laterally held and compressed by the side pressing plates (6) before or at the same time the insulated wire (20) is pressed fit into the cutting slots (22) of pressure cutters (21) so that the insulation of the wire is cut and the pressure cutter electrically contacts the wire conductor.

14 Claims, 8 Drawing Sheets

METHOD AND APPARATUS FOR PRESSURE-WELDING AN ELECTRIC WIRE TO A PRESSURE TERMINAL

This is a Continuation of application Ser. No. 08/421,903 filed Apr. 14, 1995, now abandoned.

BACKGROUND OF THE INVENTION

1. Field of the Invention

The present invention relates to a method and apparatus for pressure-welding an insulated electric wire to a pressure terminal by pressing the wire against the pressure cutters of the pressure terminal mounted in a connector housing in such a manner as to prevent the pressure cutters of the pressure terminal from being deflected outwardly when the covered wire is forced into the pressure terminal.

2. Related Art

The method of pressure-welding an insulated wire to a pressure terminal normally comprises the steps of placing the insulated wire on flat plate-like pressure cutters each having U-shaped slots, and forcing the insulated wire into the slots with pressure-welding dies. During the pressure-welding operation, the edge of the pressure cutter cuts the insulation to expose the conductors such that the conductors electrically contact the edges of the pressure cutter which define the slot.

FIG. 12 illustrates such a conventional arrangement where a pressure-welding die 104 forces the insulated wire 103 downwardly into engagement with pressure terminal 105 in a condition in which the pressure terminal 105 has been previously mounted in the terminal container 107 of a connector housing 106.

As shown in FIGS. 13 and 14, the pressure-welding die 104 has an arcuate pressing portion 112 for pressing against the wire such that the wire 103 is received in the U-shaped slot 101 of pressure cutters 102. At this time, the edge of the U-shaped slot cuts open the insulation of the wire 103 so that the conductors electrically contact the edge defining the U-shaped slot 101 and are retained thereby.

As shown in FIG. 15, when the pressing portion 112 of the pressure-welding die 104 presses the insulated wire 103 into the slot 101, opposing forces E are applied against the sides of the pressure cutter 102 tending to force them outwardly. If the arcuate pressing portion 112 of the pressure-welding die 104 keeps pressing the insulated wire 103 downward in the illustrated state, the insulation of the wire 103 will be torn by the edge of the U-shaped slot 101. When the arcuate pressing portion 112 presses the insulated wire 103 further downward, the conductors of the insulated wire 103 contact the edge of the U-shaped slot 101 and are retained thereby with a proper pressing force. Good electrical contact can thus be established. FIG. 13 shows a normal pressure-welding condition thus attained.

However, the conventional wire pressure-welding method experiences problems when, for example, the thickness and strength of the insulation are too great, the configuration of the edge of the U-shaped slot 101 is such that sufficient cutting-open force is not achievable or the strength of the pressure cutter 102 is low.

In other words, if the sides of the pressure cutter are bent outwardly in the manner shown in FIG. 16 there is a possibility that the insulation may not be completely torn so that electrical contact will not established between the conductors and the pressure cutter 102.

For example, when the insulated wire 103 has a diameter substantially equal to the inner width L of the pressure terminal 105, two problems may occur. Firstly, the wire may become shifted from the slot of the pressure terminal. Secondly, the insulation may expand outwardly in a direction perpendicular to the axis of the wire, that is, toward both the sidewalls of the pressure cutter 102, due to the pressing force. Such outward expansion of the insulation may cause the pressure cutter to expand outwardly, in the manner discussed above.

Although some pressure terminals have notches or the like in the sidewalls to allow the expanded insulation to escape, the covering material may nonetheless cause the pressure cutter to deflect outwardly since there is a practical limit to reducing the terminal size or securing sufficient strength.

For the reason stated above, design freedom decreases as the percentage of good products is decreased during the mass-production process or as the number of usable materials becomes limited. In addition, there arises a problem of preventing an increase in production cost.

SUMMARY OF THE INVENTION

An object of the present invention is to solve the foregoing problems by providing a method and apparatus for pressure-welding an electric wire to a pressure terminal, the method and apparatus therefor being capable of minimizing the deformation of pressure cutters to ensure a stable conducting connection at the time the electric wire is forced into the pressure terminal.

The object above can be accomplished by a method for pressure-welding an electric wire to a pressure terminal by means of pressure-welding dies to force an insulated wire into the cutting slots of pressure cutters of the pressure terminal mounted in a connector housing, wherein covering material to be forced into the cutting slots is laterally held between and compressed by a pair of side pressing plates and forced fit into the cutting slots before or at the same time the insulated wire is forced into the cutting slots by the pressure-welding dies.

According to the invention, the side pressing plates are each pivotally coupled to fixed members other than the pressure-welding dies and the side pressing plate is made to swing inwardly by a sliding member which is moved integrally with the pressure-welding die.

The object above can be accomplished in that the covering material of the insulated wire to be pressed fit into the cutting slots is compressed to the extent that its diameter is made smaller than the inner width of the pressure terminal.

The object above can be accomplished by an apparatus for pressure-welding an electric wire to a pressure terminal, comprising pressure-welding dies which are each equipped with recessed pressing portions for holding an insulated wire at the lower edge faces and vertically movable, and sliding members each combined with the pressure-welding dies and made to slide on fixed members, the apparatus therefor being operated to press fit the insulated wire into cutting slots formed in the pressure cutters of the pressure terminal as the pressure-welding dies moves downward, wherein covering material to be forced into the cutting slots is laterally held between and compressed by a pair of side pressing plates and forced fit into the cutting slots before or at the same time the insulated wire is forced into the cutting slots by the pressure-welding dies.

The object above can be accomplished in that the side pressing plates are each pivotally coupled to the fixed members and wherein the side pressing plate is made to swing inward by the sliding member which is moved downward integrally with the pressure-welding die.

The object above can be accomplished by a method for pressure-welding an electric wire to a pressure terminal by means of pressure-welding dies to force an insulated wire into the cutting slots of pressure cutters of the pressure terminal mounted in a connector housing, wherein at least part of covering material to be forced into the cutting slots by a pair of side pressing plates each quipped with cutting edges at their leading ends is cut open before or at the same time the insulated wire is forced into the cutting slots by the pressure-welding dies.

The object above can be accomplished in that the covering material is cut open by the side pressing plates when the pressure-welding dies are pressed downward in such a state that the covering material has abutted against the cutting edges.

The object above can be accomplished in that the cutting edges are each arranged at the inner leading ends of the side pressing plates in parallel to or at angles with the pressure-welding direction.

The object above can be accomplished by an apparatus for pressure-welding an electric wire to a pressure terminal, comprising pressure-welding dies which are each equipped with recessed pressing portions for holding an insulated wire at the lower edge faces and vertically movable, and sliding members each combined with the pressure-welding dies and made to slide on fixed members, the apparatus therefor being operated to press fit the insulated wire into cutting slots formed in the pressure cutters of the pressure terminal as the pressure-welding dies moves downward, wherein a pair of side pressing plates each equipped with cutting edges on their inner leading ends corresponding to the cutting slots before or at the same time the insulated wire is forced into the cutting slots by the pressure-welding dies are provided.

The object above can be accomplished in that the cutting edges are each arranged at the inner leading ends of the side pressing plates in parallel to or at angles with the pressure-welding direction.

In the method of pressure-welding an electric wire to a pressure terminal according to the present invention, the covering material to be forced into the cutting slots is laterally held between and compressed by the pair of side pressing plates and forced fit into the cutting slots before or at the same time the insulated wire is forced into the cutting slots by the pressure-welding dies.

Therefore, the insulated wire circular is deformed in an oval-like manner by the lateral pressing force in such a way that it extends longer vertically than horizontally. Consequently, any kind of insulated wire different in outer diameter may be pressure-welded to one pressure terminal on condition that such an insulated wire can be compressed to the extent that its diameter is made smaller than the inner width of the pressure terminal.

In the method of pressure-welding an electric wire to a pressure terminal according to the present invention, the covering material to be forced into the cutting slots is laterally held between and compressed by the pair of side pressing plates and forced fit into the cutting slots before or at the same time the insulated wire is forced into the cutting slots by the pressure-welding dies.

Consequently, the pair of side pressing plates are caused to swing after the insulated wire is inserted from the rear side and operate to hold and squash the insulated wire laterally, so that the breadth of the insulated wire circular in cross section decreases and is changed into what is vertically long in cross section.

In the method of pressure-welding an electric wire to a pressure terminal according to the present invention, at least part of covering material to be forced into the cutting slots by the pair of side pressing plates each quipped with cutting edges at their leading ends is cut open before or at the same time the insulated wire is forced into the cutting slots by the pressure-welding dies.

Consequently, the insulated wire is pressed fit into the cutting slots of the pressure cutters with low press-fitting force and since the outstretching force applied to the pressure cutters is reduced, the deformation of both side walls of the cutting slot can be prevented.

Therefore, the exposed conductors of the insulated wire surely make contact with the edges of the cutting slots to make available a conducting condition with stability.

In the apparatus for pressure-welding an electric wire to a pressure terminal according to the present invention, there are provided the pair of side pressing plates each equipped with cutting edges on their inner leading ends corresponding to the cutting slots before or at the same time the insulated wire is forced into the cutting slots by the pressure-welding dies.

Consequently, the pair of side pressing plates each swing and press against both sides of the insulated wire after the insulated wire is inserted from the rear side, and the insulated wire is pressed by the pressure-welding dies in the press-fitting direction. At this time, the cutting edges arranged in the lower portion of the insulated wire cut open at least part of the insulated wire.

DETAILED DESCRIPTION OF THE PREFERRED EMBODIMENTS

Figure 1:
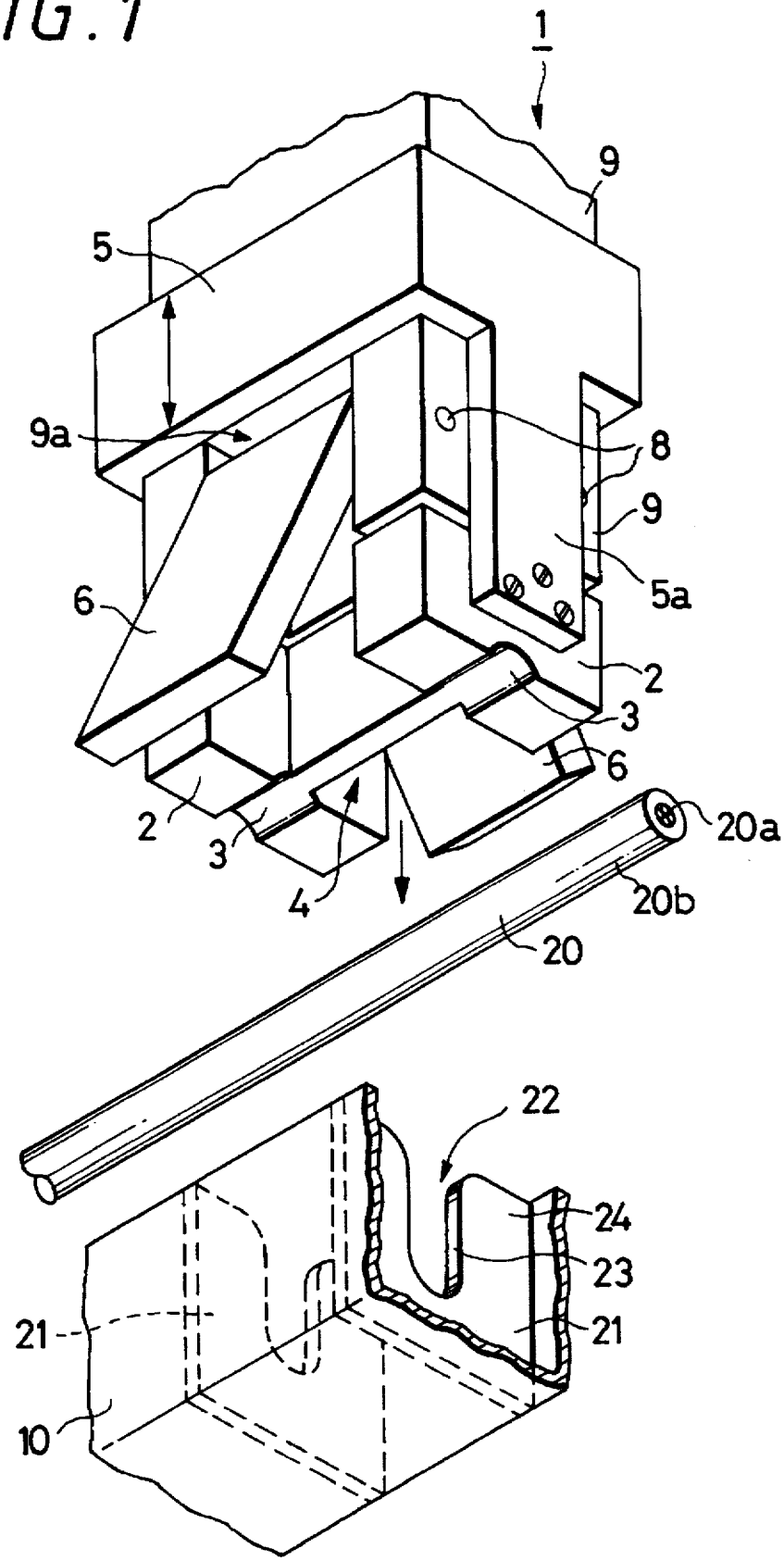
FIG. 1 is a perspective view of the principal part of an electric wire pressure-welding apparatus as a first embodiment of the present invention.
Figure 2:
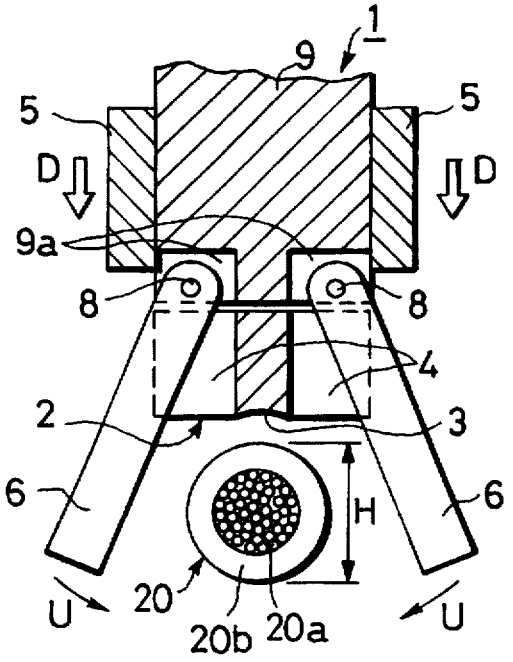
FIG. 2 is a functional diagram illustrating a state of the insulated wire of FIG. 1 before it is pressure-welded.
Figure 3:
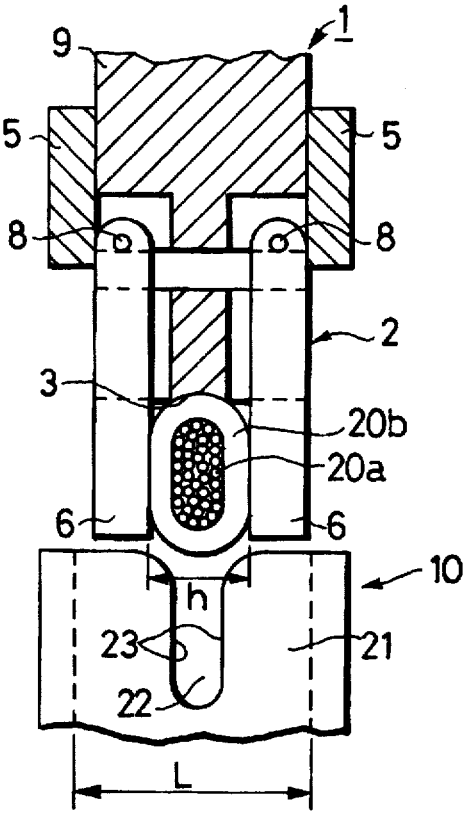
FIG. 3 is a functional diagram illustrating a state in which the insulated wire is compressed.
Figure 4:
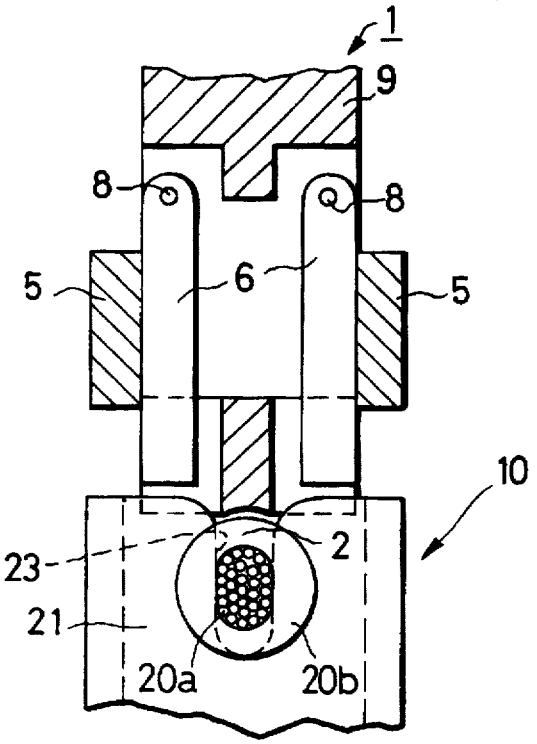
FIG. 4 is a functional diagram illustrating a state in which the insulated wire has been pressure-welded.

Referring to FIGS. 1 through 4 inclusive, a detailed description will subsequently be given of an electric wire pressure-welding method and apparatus according to a first embodiment of the present invention. FIG. 1 is a perspective view of the principal part of an electric wire pressure-welding apparatus as the first embodiment of the present invention. FIG. 2 is a functional diagram illustrating a state of the insulated wire of FIG. 1 before it is pressure-welded. FIG. 3 is a functional diagram illustrating a state in which the insulated wire is in a compressed state. FIG. 4 is a functional diagram illustrating a state in which the insulated wire has been pressure-welded.

As shown in FIG. 1, an electric wire pressure-welding apparatus 1 comprises a guide 9 constituting a vertically-extended fixed member; side pressing plates 6 constituting moving members each capable of pivoting about shaft 8 arranged in the upper portions of grooves 9*a* formed in the respective sides of the guide 9; sleeve 5 vertically slidable along the outer surfaces of the guide 9; and pressure-welding dies 2 each secured to the lower ends of protruding portions 5*a* extending from the sides of the sleeve which are perpendicular to the sides in which the pressing plates 6 are located.

When the side pressing plate 6 is stationary, a spring (not shown) maintains the lower end of the side pressing plate 6 in the outwardly pivoted position shown in FIG. 1.

In the illustrated embodiment, the pressure welding dies 2 form a unitary structure have the shape of an I-beam defining grooves 4 for receiving the pressing plates when they are pivoted downwardly. Further, the pressure-welding dies include recessed pressing portions 3 formed in the bottom surfaces thereof for engaging the insulated wire to be pressed. However, the dies need not be integral to one another.

As shown in FIG. 1, the pressure terminal includes a pressure cutter 21 having a cutting slot 22 defined by edges 23 which cut the wire when it is pressed into the slot. The cutting slot 22 is, for example, a U-shaped slot whose upper corners are curved to facilitate the pressure fitting of the insulated wire 20.

Now referring to FIGS. 2 through 4 inclusive, a description will be given of a process for pressure-welding a pressure terminal by using the electric wire pressure-welding apparatus 1.

FIG. 2 shows the initial stage at which sleeve 5 is in an upper position on the guide 9 at which the pressure welding dies 2 abut against the lower portion of the guide. In this position, the springs pivot the pressing plates outwardly about shafts 8 to an open position allowing the insulated wire 20 to be positioned in close proximity to the pressure-welding dies 2.

After the wire has been properly positioned, the sleeve 5 is lowered in the direction of arrow D (FIG. 3) such that the lower ends of the inner walls of the sleeve 5 contacts the outer surfaces of the side pressing plates 6 and force the pressing plates to pivot inwardly in the direction of arrow U. As shown in FIG. 3, after the sleeve has been moved downwardly a predetermined distance, the pressing plates squeeze the wire into an oval shape having a reduced width h which is smaller than the inner width L of pressure terminal 10.

So long as the wire is capable of being compressed such that the dimension h is smaller than width L, any kind of insulated wire, irrespective of its outer diameter, may be pressure-welded to one pressure terminal.

After the wire has been compressed in the manner discussed above, the pressure-welding dies 2 are lowered such that their recessed pressing portions 3 abut against the insulation material 20*b* of the insulated wire 20. The pressure-welding dies 2 are further lowered so that the wire is press fitted into the cutting slots 22. Since the insulated wire 20 has been deformed to have a smaller width h, the outward force applied to the pressure cutter during the press-fitting operation is reduced. Therefore, the side walls which define the cutting slot are not expanded outwardly. Also, the insulated wire 20 may be forced into the cutting slot 22 readily with a relatively low press-fitting force.

As illustrated in FIG. 4, the insulation of the wire is cut so that the conductors 20*a* are exposed and electrically contact the cutting edges of the pressure terminal.

Thereafter, the pressure-welding dies 2 along with the sleeve 5 are moved upwardly so that the side pressing plates 6 pivot to the outwardly extending, open position of FIG. 2.

As set forth above with reference to the first embodiment of the present invention, the pair of side pressing plates are caused to pivot so as to compress the wire in the lateral direction. Consequently, insulated wires having different outer diameters may be pressure-welded to one pressure terminal so long as the wire can be sufficiently compressed so that its diameter is smaller than the inner width of the pressure terminal.

Therefore, standard pressure terminals may be used for wires having various outer diameters allowing standardized tooling and attendant reduced costs.

Figure 5:
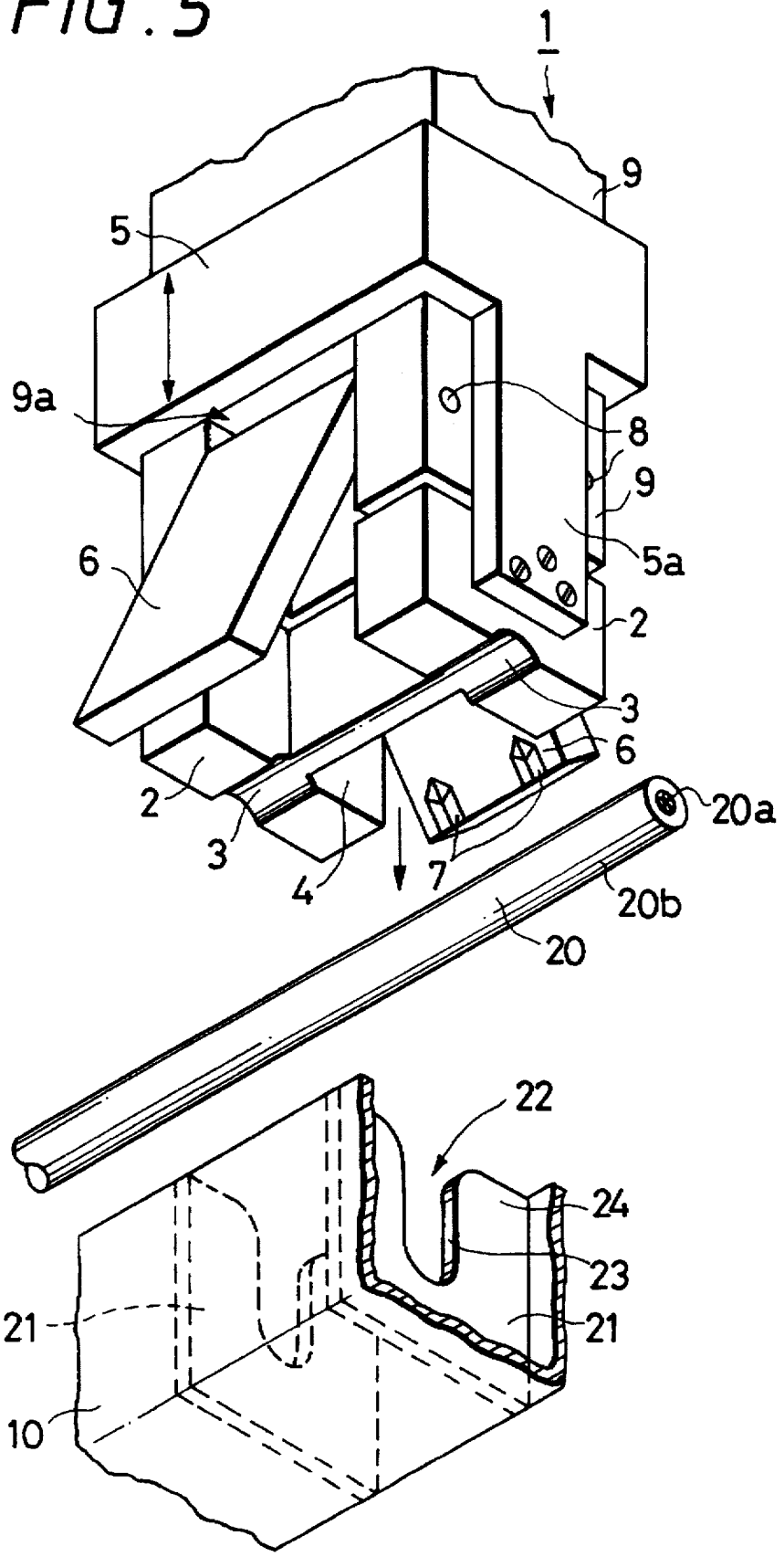
FIG. 5 is a perspective view of the principal part of an electric wire pressure-welding apparatus as a second embodiment of the present invention.
Figure 6:
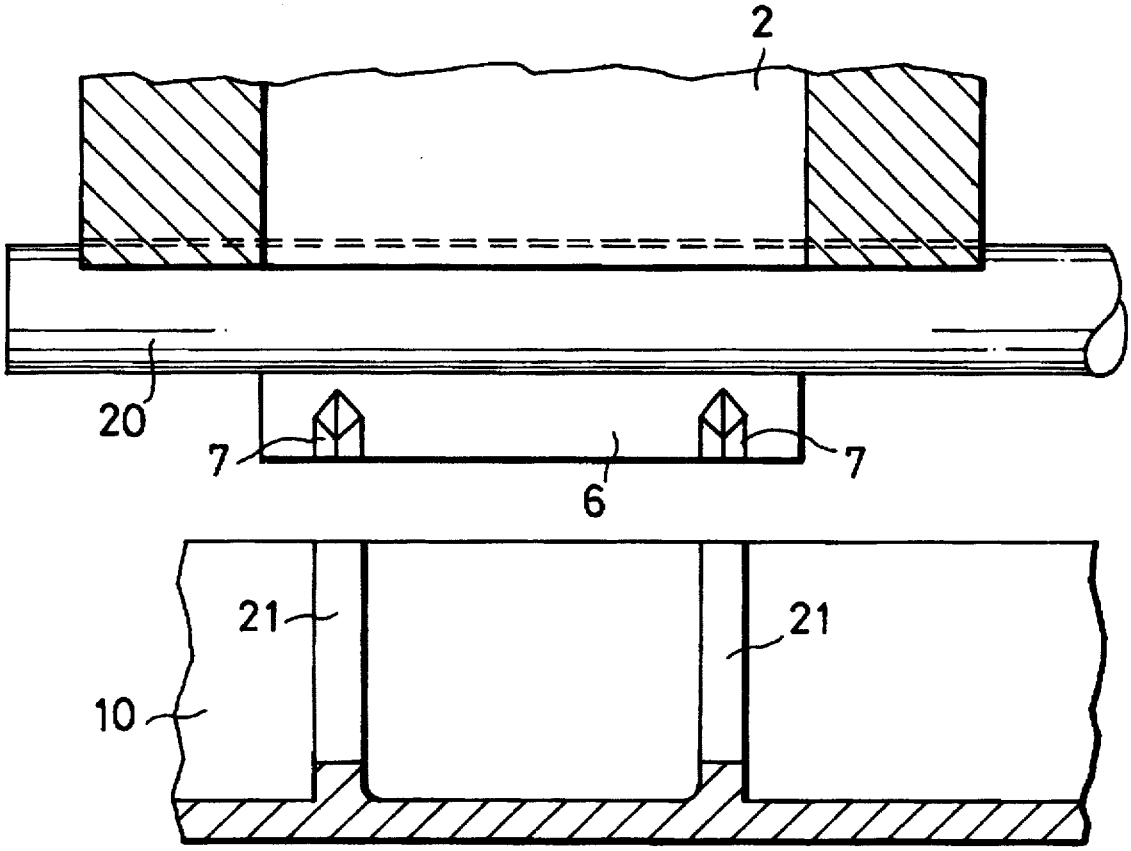
FIG. 6 is a functional diagram illustrating a state in which cutting edges of FIG. 5 are arranged.
Figure 7:
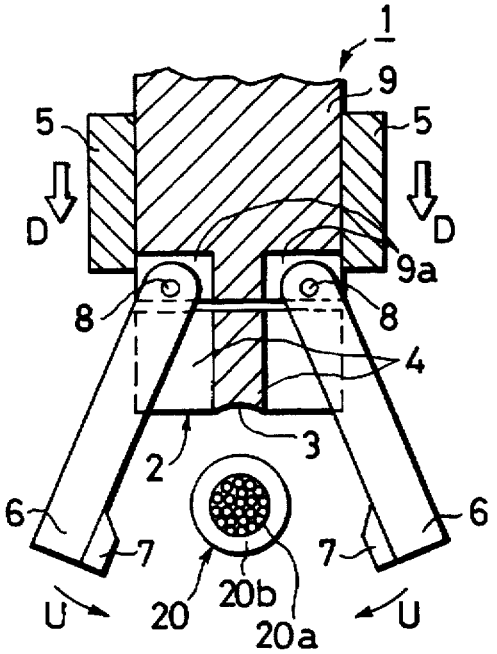
FIG. 7 is a functional diagram illustrating a state of the insulated wire of FIG. 5 before it is pressure-welded.
Figure 8:
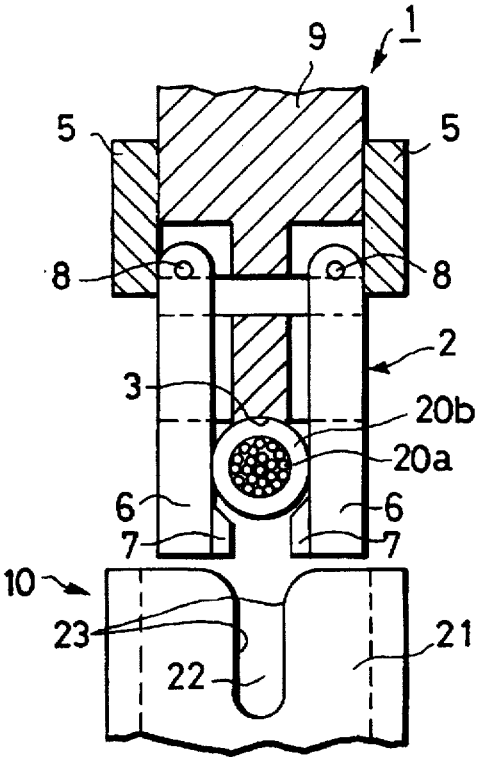
FIG. 8 is a functional diagram illustrating a state in which the insulated wire is held.
Figure 9:
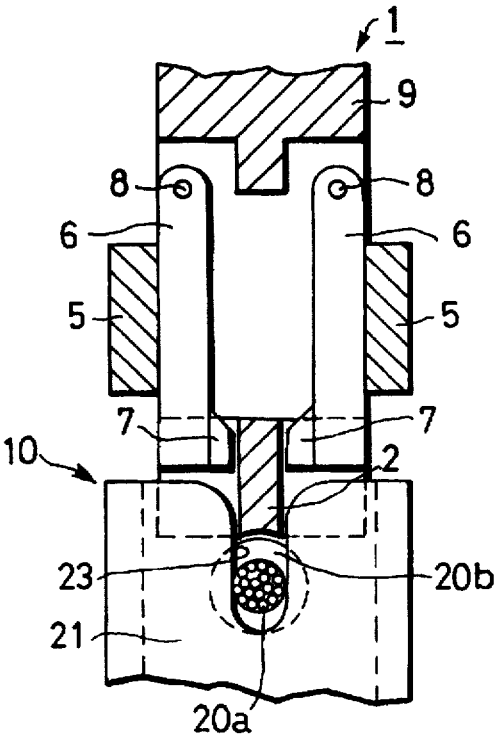
FIG. 9 is a functional diagram illustrating a state in which the insulated wire has been pressure-welded.

Referring to FIGS. 5 through 9 inclusive, a detailed description will subsequently be given of an electric wire pressure-welding method and apparatus according to a second embodiment. FIG. 5 is a perspective view of the principal part of an electric wire pressure-welding apparatus as the second embodiment of the present invention. FIG. 6 is a functional diagram illustrating a state in which cutting edges of FIG. 5 are arranged. FIG. 7 is a functional diagram illustrating a state of the insulated wire of FIG. 5 before it is pressure-welded. FIG. 8 is a functional diagram illustrating a state in which the insulated wire is held. FIG. 9 is a functional diagram illustrating a state in which the insulated wire has been pressure-welded. Incidentally, like reference characters designate like component parts in the first embodiment of the present invention and the description thereof will be omitted.

As shown in FIG. 5, the pressure-welding apparatus includes the side pressing plates 6 which are pivotable about shafts 8 located in the upper portions of the grooves 9*a* formed in the respective sides of the guide 9. According to the second embodiment, cutting edges 7, for cutting the insulation 20*b*, are each provided in the lower, inner sides of the side pressing plates 6.

As shown in FIG. 6, the cutting edges 7 are arranged in parallel in the press-fitting direction and oppose the pressure cutters 21 of the pressure terminal 10. When the insulated wire 20 is pressed downward as the pressure-welding dies 2 are lowered from above, at least a portion of the insulation material 20*b* of the wire 20 is cut.

Referring to FIGS. 7 through 9 inclusive, a description will subsequently be given of a process for pressure-welding an electric wire to the pressure terminal 10 by means of the electric wire pressure-welding apparatus 1.

FIG. 7 shows the initial stage at which sleeve 5 is in an upper position on the guide 9 at which the pressure welding dies 2 abut against the lower portion of the guide. In this position, the springs pivot the pressing plates outwardly about shafts 8 to an open position allowing the insulated wire 20 to be positioned in close proximity to the pressure-welding dies 2.

After the wire has been properly positioned, the sleeve 5 is lowered in the direction of arrow D (FIG. 7) such that the lower ends of the inner walls of the sleeve 5 contact the outer surfaces of the side pressing plates 6 and force the pressing plates to pivot inwardly in the direction of arrow U.

Continued downward movement causes the recessed pressing portions 3 thereof to contact the surface of the covering material 20*b*. When the sleeve 5 is lowered further, the recessed pressing portions 3 at the lower ends of the pressure-welding dies 2 press the insulated wire 20 downward so that the lower portion of the insulation material 20*b* abuts against the upper ends of the cutting edges 7. Finally, further downward movement causes the cutting edges 7 to cut the insulation material 20*b* of the wire 20.

In this case, the degree to which the insulation is cut depends on the overall strength of the insulation material 20*b* and the pressure cutters 21. If the insulation has a high-strength or is relatively thick, for example, the initial cut may be relatively shallow.

As set forth above, the cutting edges 7 cut open at least a portion of the insulation material 20*b*. When the sleeve is lowered further, the insulated wire 20 passed beyond the cutting edges 7 and the insulation is further cut by the pressure cutters 21 when the wire is forced into the cutting slots. Since the insulation material 20*b* was first cut by cutting edges 7, secondary cutting by the pressure cutters is easily performed.

Specifically, when the initial cut is shallow, the conductors 20*a* may be completely exposed by slightly cutting open the insulation material 20*b* during the secondary cut performed by the edge 23 of the cutting slots 22. In a case where the initial cut has exposed the conductors, the secondary cut by pressure cutter 21 may simply serve to widen the cut.

In either case, the outstretching force applied to the cutting slots 22 of the pressure cutters 21 is by far reduced in comparison with the prior art method. Consequently, the pressure cutters 21 are prevented from being deformed during the pressure-welding operation.

After the conductors 20*a* have been sufficiently exposed, the conductors electrically contact the edges 23 defining cutting slot 22, as shown in FIG. 9. Thereafter, the pressure-welding dies 2 together with the guide 9 are moved upward again upon the completion of the pressure-welding operation and the side pressing plates 6 equipped with the cutting edges 7 are returned to the open state of FIG. 7.

Figure 10:
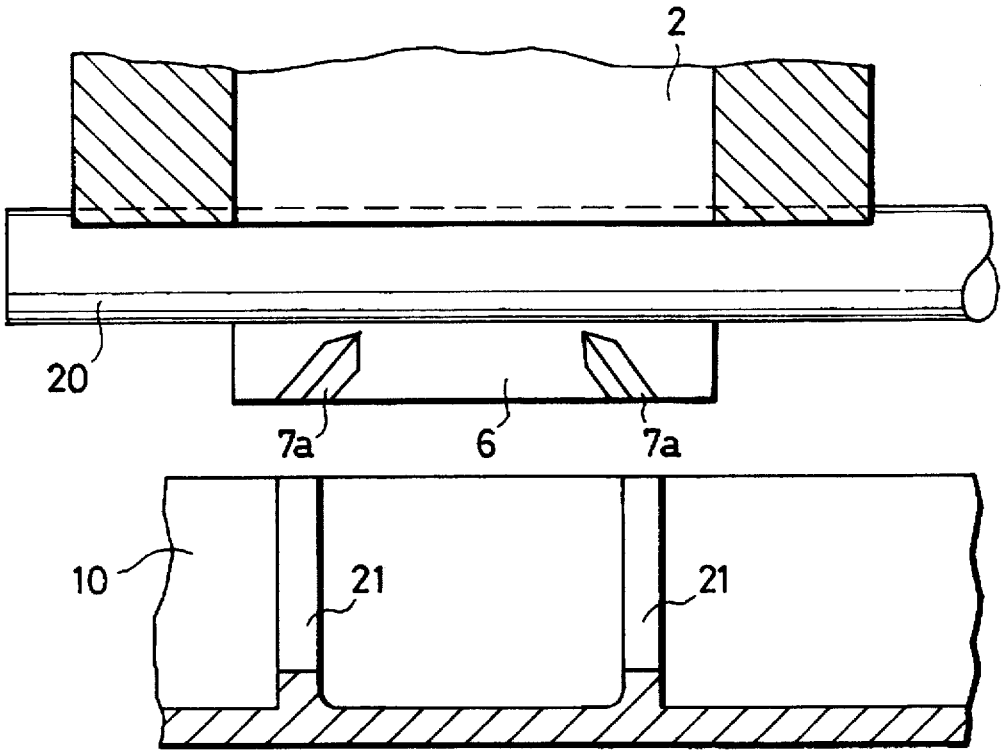
FIG. 10 is a diagram illustrating a modified arrangement of cutting edges different from what is shown in the second embodiment of the present invention.
Figure 11:
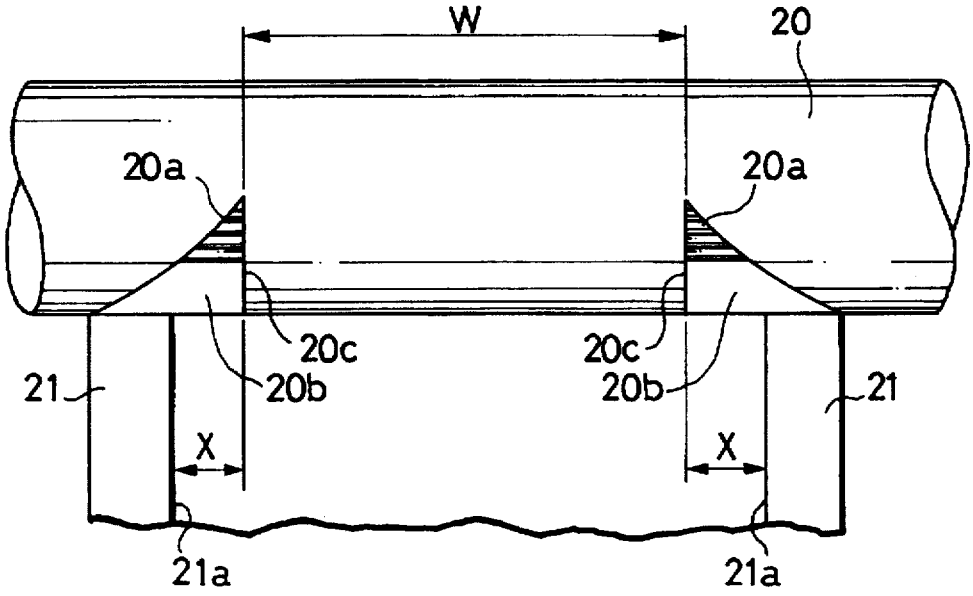
FIG. 11 is a diagram illustrating a cutout configuration formed by the cutting edges.
Figure 12:
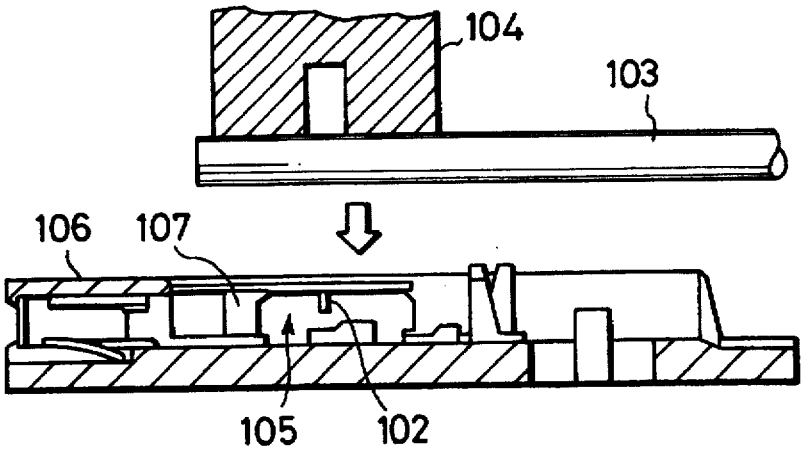
FIG. 12 is a functional diagram illustrating a conventional apparatus for pressure-welding an electric wire to a pressure terminal.
Figure 13:
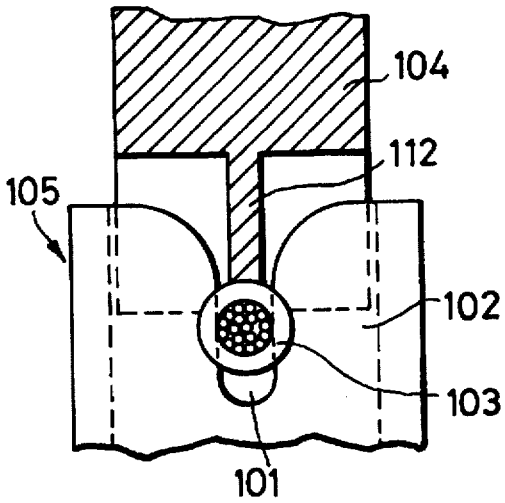
FIG. 13 is a functional diagram illustrating a pressure-welded insulated wire of FIG. 12.
Figure 14:
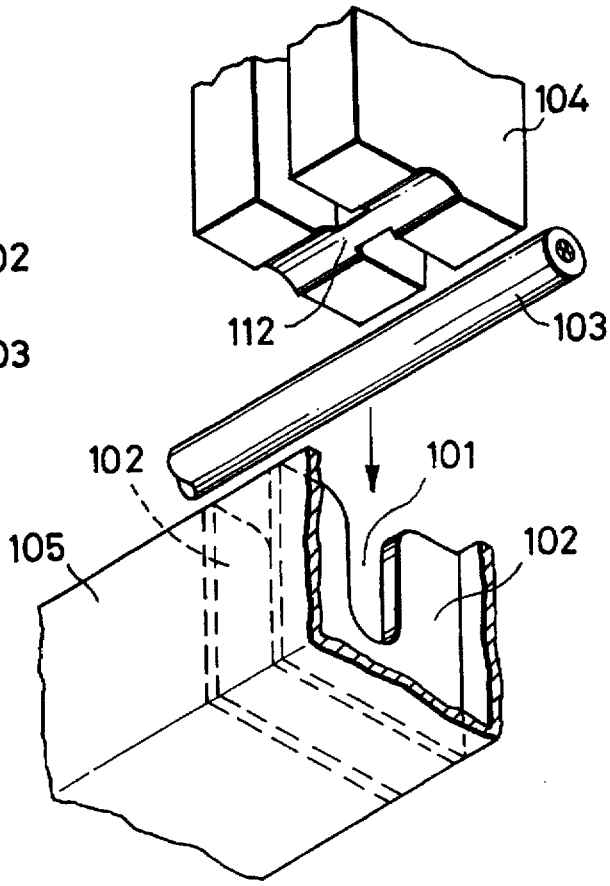
FIG. 14 is a perspective view of the principal part of FIG. 12.
Figure 15:
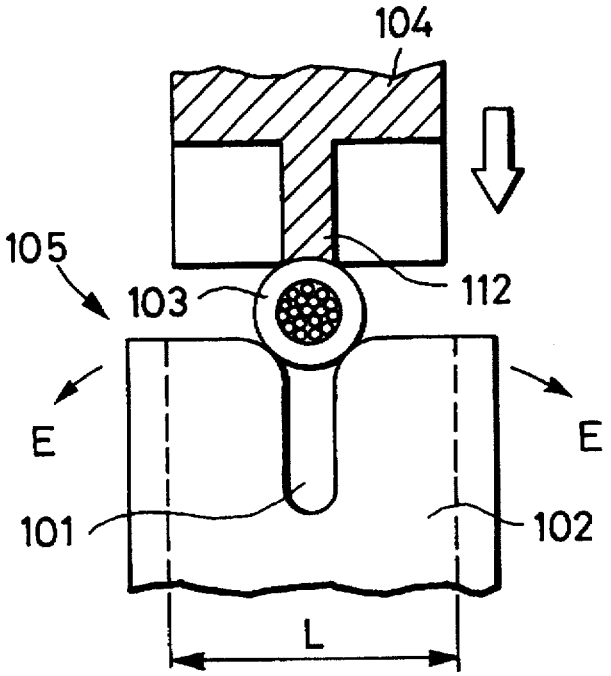
FIG. 15 is a functional diagram illustrating a pressure-welding process in FIG. 12.
Figure 16:
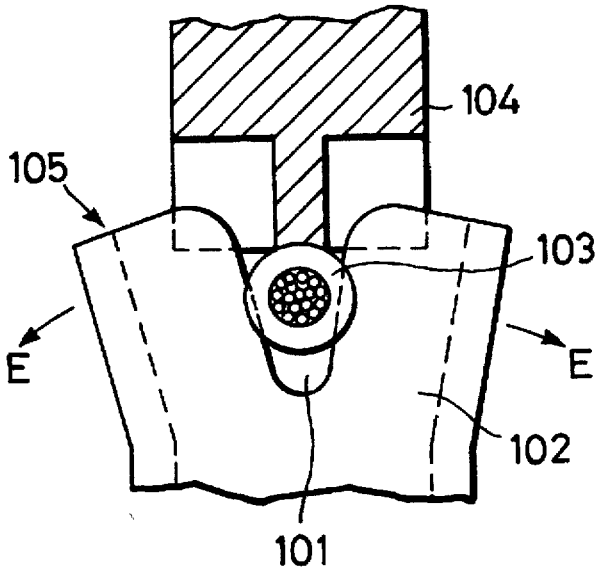
FIG. 16 is a functional diagram illustrating an abnormal pressure-welded state in FIG. 12.

Referring to FIGS. 10 and 11, a description will subsequently be given of a modified version of the second embodiment of the present invention. FIG. 10 is a diagram illustrating a modified arrangement of cutting edges different from what is shown in the second embodiment thereof; and FIG. 11 illustrates a cutout configuration formed by the cutting edges.

As shown in FIG. 10, cutting edges 7*a* are arranged on the inner side face of the side pressing plate 6 opposite to the pressure cutter 21 of the pressure terminal 10 and also arranged at angles with respect to the press-fitting direction. In other words, the pair of the cutting edges 7*a* are fixedly inclined in directions in which they face each other. With the cutting edges 7*a* thus inclined, the quantity of insulation material 20*b* which is removed is greater than that which is removed by the parallel gutting edges 7 described in the previous embodiment. Therefore, the removal quantity thus increased may accommodate any deviation of dimensional precision of the pressure cutters 21.

Consequently, the amount of insulation material 20*b* removed is designed to be greater that the width of the pressure cutters. Further, it is important that the distance between the cutters 21 exceed the length W of the cut, as shown in FIG. 11.

According to the invention, the covering material which expands in a direction perpendicular to the axis of the wire (i.e., toward the side walls of the terminal) is allowed to escape in the direction of the wire during the pressure-welding operation. More specifically, since there is a space X available between the cutting end and the corresponding inner wall surface 21*a* of the pressure cutter 21, the covering material may expand in that space X.

Therefore, the outstretching force applied to the pressure cutters during the electric wire press-fitting operation is considerably reduced to ensure that the deformation of the pressure cutters is prevented. Thus the insulated wire 20 can more readily be forced into the pressure cutters 21 with low press-fitting force.

As set forth above with reference to the second embodiment of the present invention, the pair of side pressing plates each swing and press against both sides of the insulated wire after the insulated wire is inserted from the rear side, and the insulated wire is pressed by the pressure-welding dies in the press-fitting direction. At this time, the cutting edges arranged in the lower portion of the insulated wire cut open at least part of the insulated wire.

Thus the insulated wire is pressed fit into the cutting slots 22 of the pressure cutters 21 with low press-fitting force and since the outstretching force applied to the pressure cutters is reduced, the deformation of both side walls of the cutting slot can be prevented.

Accordingly, the exposed conductors of the insulated wire surely contact the edges of the cutting slots to perform a conducting condition with reliability and stability.

The first and second embodiments of the present invention as set forth above may be combined together. More specifically, the insulating material to be pressed fit into the cutting slots is laterally held and compressed by the pair of side pressing plates equipped with the cutting edges at their respective leading ends before or at the same time the insulated wire is pressed fit into the cutting slots by the pressure-welding dies. Then the insulated wire is pressed downward by the pressure-welding dies in the press-fitting direction, and at least part of the covering material is cut open before being pressed fit into the slots, whereby the press-fitting of the insulated wire into the cutting slots of the pressure cutters is carried out with lower press-fitting force.

In other words, any kind of insulated wire, having different outer diameters, may be pressure-welded to one pressure terminal as long as the insulated wire can be compressed to the extent that its lateral dimension is smaller than the inner width of the pressure terminal. Since at least part of the covering material to be pressed fit is cut open, the outstretching force applied to the pressure cutters is reduced further to ensure that the deformation of both side walls of the cutting slot is prevented.

The construction of the electric wire pressure-welding apparatus 1 including the side pressing plates 6 in the embodiments described above is what exemplifies the implementation of a method for pressure-welding an electric wire to a pressure terminal according to the present invention. The present invention is needless to say not limited to these methods of pressure-welding electric wires to pressure terminals but may be implemented by various electric wire pressure-welding apparatus different in construction.

Although the side pressing plates 6 are each caused to pivot on the shafts 8 in the electric wire pressure-welding apparatus 1 thus constructed, side pressing plates capable of reciprocating in a horizontal direction perpendicular to the moving direction of the sleeve 5, in place of the side pressing plates 6, may be employed. In this case, cutting edges may arranged at the leading end of the side pressing plate.

In the method and apparatus for pressure-welding an electric wire to a pressure terminal according to the present invention as set forth above, the pair of side pressing plates swing so as to hold and compress an insulated wire laterally for the purpose of decreasing the width of the insulated wire. Any kind of insulated wire different in outer diameter may thus be pressure-welded to one pressure terminal on condition that such an insulated wire can be compressed to the extent that its diameter is made smaller than the inner width of the pressure terminal.

Therefore, the pressure terminal itself is rendered usable for the general purpose and this not only makes it unnecessary to design and manufacture pressure terminals capable of dealing with different kinds of insulated wires but also simplifies tool management, thus making cost reduction feasible.

The pair of side pressing plates each pivot and press against both sides of the insulated wire after the insulated wire is inserted from the rear side, and the insulated wire is pressed downward in the press-fitting direction as the pressure-welding dies are lowered. At this time, the cutting edges arranged in the lower portion of the insulated wire cut open at least part of the insulated wire. Thus the insulated wire is pressed fit into the cutting slots of the pressure cutters with low press-fitting force and since the outstretching force applied to the pressure cutters is reduced, the deformation of both side walls of the cutting slot can be prevented.

Even in a case where the thickness and strength of the covering material of the insulated wire are greater or where the configuration of the edge of the cutting slot is such that sufficient cutting-open force is unavailable, the exposed conductors of the insulated wire surely make contact with the edges of the cutting slots to ensure a conducting condition with reliability and stability.

What is claimed is:

1. A method of pressure-welding an electric wire including a conductor circumscribed by an insulation to a pressure terminal including a bottom wall, pair of side walls and a pressure cutter having a wire cutting slot defined by opposing cutting edges, said method comprising the following steps:

positioning the wire between a pressure-welding apparatus and the pressure terminal;

squeezing the wire with the pressure welding apparatus so as to reduce the lateral dimension thereof; and forcing the wire with the pressure-welding apparatus into the cutting slot such that said cutting edges cut the insulation of the wire and electrically contact the conductor thereof.

2. The method of claim 1, wherein said squeezing step comprises the following steps:

locating the wire between a pair of pressing plates; and pivoting said pressing plates such that said pressing plates squeeze said wire into an oval shape.

3. The method of claim 1, wherein said squeezing step comprises squeezing said wire so that the lateral dimension thereof is smaller than the distance between inner surfaces of said side walls of the pressure terminal.

4. The method of claim 1, further comprising the step of cutting the insulation of said wire before said forcing step.

5. The method of claim 2, wherein said forcing step comprises the step of moving said wire relative to said pressing plates such that said wire slides along said pressing plates.

6. The method of claim 5, further comprising the step of cutting said insulation as said wire is moved along said pressing plates.

7. The method of claim 6, wherein said cutting step is performed by providing a cutting edge on each of said pressing plates, said wire passing over each said cutting edge.

8. An apparatus for pressure-welding an electric wire, including a conductor circumscribed by an insulation, to a pressure terminal, the pressure terminal including a bottom wall and a pair of sidewalls defining a portion in which a cutting member is received, said cutting member having a cutting slot defined by opposing cutting edges, the apparatus comprising:

a guide member;

compressing means attached to said guide member for compressing said wire so as to reduce a lateral dimension thereof; and a pressing die for moving said squeezed wire in a wire insertion direction toward said pressure terminal and into said cutting slot of said terminal, wherein when said wire is pressed into said slot, the edges of said slot cut said insulation and electrically contact said conductor.

9. The apparatus of claim 8, wherein said compressing means comprises a pair of pressing plates pivotally secured to said guide member and a sleeve circumscribing said guide member, said sleeve being movable along said guide member so as to forcibly pivot said pressing plates and, attendantly, squeeze said wire.

10. The apparatus of claim 9, wherein said sleeve is secured to said pressing die such that downward movement of said sleeve attendantly causes said pressing die to move downwardly.

11. The apparatus of claim 9, wherein each of said pressing plates includes a cutter for initially cutting said insulation material before said wire is completely received in said cutting slot.

12. The apparatus of claim 11, wherein said cutter comprises a cutting edge provided on each of said pressing plates which is inclined with respect to said wire insertion direction.

13. The apparatus of claim 8, wherein said pressing die includes two dies.

14. The apparatus of claim 8, wherein said pressing die includes a recessed portion for receiving said wire therein.

* * * * *